US005496171A

United States Patent [19]

Ozawa et al.

[11] Patent Number: 5,496,171

[45] Date of Patent: Mar. 5, 1996

[54] SURFACE COMBUSTION BURNER

[75] Inventors: Hidenari Ozawa, Musashino; Kazutaka Kato, Tokyo; Keiichi Ohgi, Tokyo; Masahiro Yahagi, Tokyo, all of Japan

[73] Assignee: Tokyo Gas Co., Ltd., Tokyo, Japan

[21] Appl. No.: 295,491

[22] Filed: Aug. 25, 1994

Related U.S. Application Data

[62] Division of Ser. No. 994,328, Dec. 21, 1992, abandoned.

[30] Foreign Application Priority Data

| | | | |
|---|---|---|---|
| Dec. 24, 1991 | [JP] | Japan | 3-341334 |
| Dec. 24, 1991 | [JP] | Japan | 3-341336 |
| May 21, 1992 | [JP] | Japan | 4-033673 U |

[51] Int. Cl.[6] ..... F23D 3/40

[52] U.S. Cl. ..... 431/326; 431/284; 431/328; 126/92 AC

[58] Field of Search ..... 431/326, 327, 431/328, 329, 284; 126/39 J, 91 R, 92 B, 92 AC

[56] References Cited

U.S. PATENT DOCUMENTS

| | | | |
|---|---|---|---|
| 3,077,922 | 2/1963 | Soucie | 431/328 |
| 3,150,711 | 9/1964 | Brown et al. . | |
| 3,606,612 | 9/1971 | Reid, Jr. | 431/284 |
| 3,772,427 | 11/1973 | Moore . | |
| 3,843,313 | 10/1974 | Helgeson | 431/284 |
| 5,197,872 | 3/1993 | Martinez | 431/328 |

FOREIGN PATENT DOCUMENTS

| | | | |
|---|---|---|---|
| 0331037 | 9/1989 | European Pat. Off. . | |
| 1552220 | 3/1969 | France . | |
| 8908324 | 11/1990 | Germany . | |
| 61-106728 | 7/1986 | Japan . | |
| 61-106727 | 7/1986 | Japan . | |
| 62-80417 | 4/1987 | Japan . | |
| 62-63526 | 4/1987 | Japan . | |
| 258917 | 11/1987 | Japan | 431/329 |

OTHER PUBLICATIONS

Miura Co., Ltd., Patent Abstracts of Japan, vol. 11, No. 255 (M–617) Aug. 19, 1987 & JP–A–62 062 111 Mar. 18, 1987.

Rinnai Corp., Patent Abstracts of Japan, vol. 13, No. 170 (M–817) Apr. 21, 1989 & JP–A–10 03 407 Jan. 9, 1989.

*Primary Examiner*—James C. Yeung

*Attorney, Agent, or Firm*—Armstrong, Westerman, Hattori, McLeland & Naughton

[57] ABSTRACT

The present invention intends to provide a surface combustion burner which can permit high intensity combustion at the burner surface by preventing the occurrence of a lift phenomenon of flames due to whirling of air from the peripheral portion of the surface combustion burner. To this end, a mixing chamber positioned rearwardly of a porous member having its front surface constituting a combustion surface is divided by a partition wall into a first mixing chamber positioned at a central portion and a second mixing chamber positioned to surround the first mixing chamber so that fuel gas mixtures at different air ratios are supplied to the first and second mixing chambers, respectively, and/or the porous member having its front surface serving as the combustion surface has a resistance against the flow velocity of fuel gas mixture which is higher at a peripheral edge nearby region than at the remaining region.

5 Claims, 7 Drawing Sheets

SURFACE COMBUSTION BURNER

This application is a division of application Ser. No. 07/994,328 filed Dec. 21, 1992, now abandoned.

TECHNICAL FIELD TO WHICH THE INVENTION BELONGS

The present invention relates to surface combustion burners and more particularly to a surface combustion burner which can ensure high intensity combustion at the burner surface by preventing the occurrence of a so-called lift phenomenon of flames caused by whirling of air from the burner peripheral portion.

PRIOR ART

Conventionally, a surface combustion burner has been known wherein a planar porous member made of, for example, ceramics and having small porosities, which pass from rear side to front side and are sufficient to permit a fuel gas mixture to diffuse, is provided and the fuel gas mixture supplied to the rear surface of the planar porous member diffuses to reach the front surface thereof and is burnt near the front surface of the porous member. In this type of surface combustion burner, the planar porous member is heated to incandesce so as to discharge part of energy as radiation heat and temperature at the rear surface is not raised considerably even when combustion temperature at the front surface is raised considerably to prevent counter flames :from occurring because the porous member made of ceramics or the like has usually a small thermal conductivity. For these reasons, the conventional surface combustion burner has been used as a safe burner of high thermal efficiency not only in domestic combustors but also in a variety of fields ("Combustibility of Metal Fiber Burner" by Kuwabara, Combustion Study, Vol. 81, August, 1989, Nippon Nenryo Kenkyu-kai and "Development and Combustion Characteristics of Metal Fiber Burner" by Kuwabara et al, Industrial Heating, January, 1991, Nippon Kohgyoro Kyokai, Vol. 28, No. 1).

A typical construction of the surface combustion burner will now be described with reference to FIG. 9. In a surface combustion burner 10 shown in FIG. 9, a square, or circular, planar porous member 11 is mounted to the front side of a rectangular, or cylindrical, casing 13 through a heat resistant packing 12. The front end of the casing 13 is bent inwardly at light angles to form a flange 14 and the flange 14 covers a region near the peripheral edge (hereinafter referred to as a peripheral edge nearby region) of the porous member 11 by a constant width to engage the porous member 11, thus positioning the porous member 11 in the frontward direction.

Typically, the porous member 11 is a sintered body of long fibers made of an alloy of iron, chromium, silicon, aluminum and yttrium, thus being heat resistant for temperatures of 1200° C., or more and similarly a ceramic fiber sheet, being highly heat resistant, is used as the heat resistant packing. Disposed in the casing 13 is fuel gas mixture distributing means 20 adapted to diffuse a fuel gas mixture so as to distribute the mixture uniformly over the rear surface of the planar porous member 11. The fuel gas mixture distributing means 20 is formed of the same material as that of the casing 13 and consists of a hindrance plate 21 positioned in parallel to the porous member 11 and an annular member 22 fixed to the periphery of the hindrance plate 21 by suitable means. The annular member 22 has a ⊃-shaped sectional form as shown in FIG. 9, forming a circulating path 26 and has its inner peripheral wall 23 formed with a plurality of openings 24 and a plurality of openings 25 which are frontally and rearwardly of the hindrance plate 21, respectively. The annular member 22 has its outer periphery of the same contour as that of the inner peripheral wall of the casing 13 and is press-fitted in the casing 13 from the back thereof to support the rear surface of the planar porous member 11 by pressing the front surface thereof against the flange 14 of the casing.

The fuel gas mixture distributing means 20 is supported by a back plate 30 having the same contour as that of the inner peripheral wall of the casing 13. The back plate 30 is bent at its peripheral edge, to form a bent, portion 31 and the tip of the bent portion 31 and the rear end of the casing 13 are welded at 35 throughout the circumference. A pipe 32 is fixedly secured to a central portion of the back plate 30, by suitable means, and the pipe 32 is connected to a fuel gas supply source, through suitable piping means, not shown.

Accordingly, a mixing chamber 40, forming an airtightly closed space, is defined by the casing 13, planar porous member 11 and back plate 30, and the mixing chamber 40 is divided into the aforementioned circulating path 26 constituting the fuel gas mixture distributing means 20 and defined by the annular member 22 and casing 13, into a front mixing chamber 41 defined by the planar porous member 11 and hindrance plate 21, and into a rear mixing chamber 42 defined by the hindrance plate 21 and back plate 30.

Combustion in the surface combustion burner is carried out as will be described below. A fuel gas mixture from the suitable fuel source is supplied under pressure into the rear mixing chamber 42 through the cylindrical member 32. The fuel gas mixture supplied, under pressure, impinges upon the hindrance plate 21 to change its flow direction so that it may enter the circulating path 26 through the openings 25 formed in the inner peripheral wall 23 of the annular member 22, again change its direction and then enter the front mixing chamber 41 through the openings 24. During this flow action, fuel and air are mixed sufficiently and uniformly. The uniformly mixed fuel gas mixture enters into the rear surface of the planar porous member 11, passes through porosities contiguous to the rear surface to reach the front surface and is burnt into combustion at the front surface of the porous member 11 excepting the portion covered with the aforementioned flange 14 of the casing 13. Through the combustion, the front surface of the planar porous member 11 incandesces to discharge radiation heat.

PROBLEMS THAT THE INVENTION IS TO SOLVE

The surface combustion burner as described above is very effective from the standpoint of effective utilization of heat and safety. However, when the high load, lean premixed, combustion is carried out at a high air ratio, a lift phenomenon of flames takes place leading to unstable combustion and therefore high intensity combustion exceeding a predetermined limit is not allowed to proceed and thereby impose a limitation on the combustion load range. When high intensity operation is effected, within an allowable range, NOx is usually liable to occur relatively easily within this range and therefore the burner is required to be improved in combustion load, as well as, prevention of environmental pollution.

Countermeasures to solve these disadvantages are known including an expedient as disclosed in Japanese Utility Model Application Laid-open No. 62-63526, wherein a great number of recesses b1 are formed in the front and rear surfaces of a porous member a1 so that averaged flow velocity of a fuel gas mixture may be reduced, even during high intensity combustion, to suppress the generation of lift (see FIG. 10). Another expedient as disclosed in Japanese Utility Model Application Laid-open No. 62-63524 wherein a great number of small holes b2 are formed in a porous member a2 vertically to the surface thereof so that flow velocity of a fuel gas mixture may be reduced at other portions of the combustion surface than the small holes to prevent the occurrence of a lift phenomenon (see FIG. 11).

In any of the above expedients, the occurrence of lift is suppressed by suppressing averaged flow velocity over the entire area of the combustion surface of the porous member and, inevitably, a limitation is imposed on high intensity combustion.

To solve the above problems, the present inventors have studied the lift phenomenon thoroughly to have a knowledge of the fact that a lift phenomenon in the surface combustion burner does not occur uniformly over the entire combustion surface but frequently occurs at the outer peripheral edge of the combustion surface during an early phase of combustion. Such lift phenomenon, occurring at the peripheral edge, affects combustion flames at an inward portion, giving rise to a cause of generation of lift. Conceivably, a phenomenon of whirling ambient air, caused by flames, takes place at the outer peripheral edge of the combustion surface to accelerate the lift phenomenon.

It is an object of the invention to eliminate the disadvantges of the conventional surface combustion burners and provide a surface combustion burner which can permit stable high load lean premixed combustion to thereby ensure stable combustion over a wide load range. It is another object of the invention to provide a compact surface combustion burner capable of effecting low NOx combustion.

SUMMARY OF THE INVENTION

To accomplish the above objects, the present invention discloses a first embodiment according to which, in a surface combustion burner comprising a porous member having its front surface constituting a combustion surface, a casing extending rearwards from an outer periphery nearby rear surface of the porous member, a mixing chamber defined by the porous member and the casing, and opening means for supplying a fuel gas mixture to the mixing chamber, the mixing chamber, is divided by a partition wall into a first mixing chamber positioned at a central portion, and a second mixing chamber, positioned to surround the first mixing chamber, and openings are provided for supplying fuel gas mixtures to the first and second mixing chambers, respectively.

When using the surface combustion burner of this embodiment, fuel gas mixtures, at different air ratios, are supplied to the first mixing chamber and second mixing chamber. For example, a fuel lean mixture (having an air ratio of, for example, about 1.3 to 2.0), which makes flames blue, is supplied to the first mixing chamber confronting the central portion of the porous member and, at the same time, a fuel mixture (having an air ratio of, for example, about 1.0 to 1.2) which incandesces the porous member, or makes flames pale blue, is supplied to the second mixing chamber positioned to surround the outer periphery of the first mixing chamber.

Through this, stable combustion is obtained at the peripheral portion of the porous member to maintain a stable combustion state and, on the other hand, high load lean premixed flame combustion is effected at the inward portion. While the high load lean premixed combustion proceeds, combustion of stable flames surrounding the pale blue flames continues at the peripheral edge portion and so whirling of air originating at the peripheral edge and affecting the high load, lean premixed, combustion portion can be prevented completely, with the result that the flames of the high load, lean premixed, combustion can be sustained stably for a long time without causing a lift phenomenon. In other words, stable combustion can be ensured over a wide combustion load range.

Through this, the generation of NOx can be reduced to a great extent and, as compared to the conventional burner, a larger combustion load can be obtained for the same combustion area to permit the burner, as a whole to be reduced in size.

To accomplish the above objects, the present invention further discloses a second embodiment according to which, in a surface combustion burner comprising a porous member having its front surface constituting a combustion surface, a casing extending rearwards from an outer periphery nearby rear surface of the porous member, a mixing chamber defined by the porous member and the casing, and opening means for supplying a fuel gas mixture to the mixing chamber, the porous member has a resistance against the flow velocity of fuel gas mixture which is made to be higher at a peripheral edge nearby region of the porous member than at the remaining region.

Further, as the porous member suitable for accomplishing the above objects, a porous member, for use in the surface combustion burner, is disclosed having a resistance against the flow velocity of fuel gas mixture which is made to be higher at a peripheral edge nearby region of the porous member than at the remaining region.

As a material of the porous member, a sintered body of long fibers, made of an alloy of iron, chromium, silicon, aluminum and yttrium, is preferable, but the material is not limited thereto and conventionally known materials may be used as necessary.

To accomplish the above objects, the present invention discloses a third embodiment according to which, in a surface combustion burner comprising a porous member having its front surface constituting a combustion surface and a great number of small porosities which pass from rear side to front side, and a mixing chamber disposed rearwardly of the porous member so that a fuel gas mixture supplied to the mixing chamber may pass through the porous member to the front surface thereof so as to be burnt at the front surface serving as the combustion surface, a great number of through holes, having diameters each larger than that of a small porosities of the porous member, are formed in the porous member substantially vertically to the surface thereof and the great number of through holes are sorted into several kinds of groups of through holes having different diameters.

Preferably, the great number of through holes are formed in the porous member in a pattern in which the diameters of through holes are changed stepwise from the center of the porous member to the outer periphery thereof or in a pattern in which through holes of small diameter surround through holes of large diameter.

According to another preferred embodiment of the invention, used as the porous member in the surface combustion burner, in accordance with the first embodiment, is the porous member in accordance with the second embodiment i.e., a porous member having a resistance against the flow velocity of fuel gas mixture which is made to be higher at a peripheral edge nearby region of the porous member than at the remaining region, and according to a still another preferred embodiment, used as the porous member in the surface combustion burner in accordance with the first embodiment is the porous member in accordance with the third embodiment i.e., a porous member which has a great number of through holes having diameters each larger than that of a small porosities of the porous member and formed substantially vertically to the surface thereof, the great number of through holes being sorted into several kinds of groups of through holes having different diameters.

As the materials of the casing constituting the burner according to the invention and of the porous member, the materials used in the burner of the conventional structure can be used without alternation.

BRIEF DESCRIPTION OF THE DRAWINGS

Further objects and advantages of the present invention will become apparent from the following detailed description taken in conjunction with the accompanying drawings.

DESCRIPTION OF THE PREFERRED EMBODIMENTS

Figure 1:
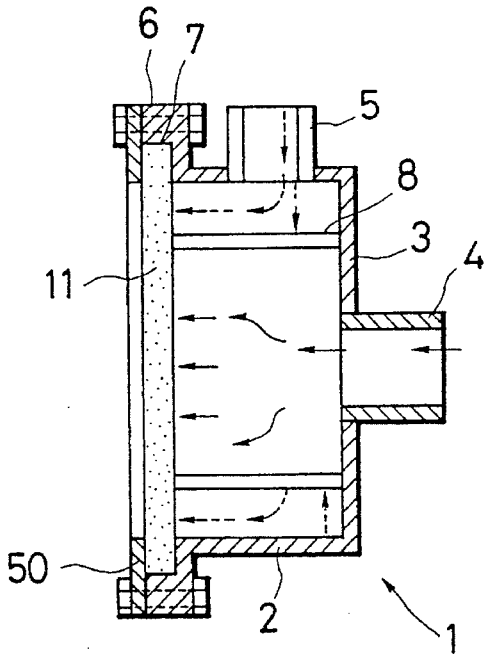
FIG. 1 is a sectional view of a surface combustion burner according to the first embodiment of the invention.

FIG. 1 is a sectional view showing a preferred embodiment of a surface combustion burner 1 according to the present invention. In the surface combustion burner 1, a casing 2 has a bottomed cylindrical form which is opened frontwards, a first tube 4 is fixedly secured at a suitable site to a bottom 3 of the casing 1 by suitable means, a second tube 5 is fixedly secured at a suitable site to the peripheral wall of the cylindrical casing also by suitable means, and the tubes 4 and 5 are connected to a fuel gas supply source through conduit means to be described later.

The opened front end of the casing 2 terminates in a portion 6 of enlarged diameter having a predetermined depth and a plurality of openings 7 are formed in the enlarged diameter portion 6. A cylindrical partition wall 8 having a smaller diameter than that of the casing 2 is fixedly secured, inside the casing, to the bottom 3 thereof by suitable means. The partition wall 8 is flush with a front surface of the bottom of the enlarged diameter portion 6.

A porous member 11 is received in the enlarged diameter portion 6 of the casing 2 and a tap member 50 having its peripheral edge portion formed with openings is applied so that the porous member may be mounted to the casing 2 securedly by means of bolts and nuts. Although not shown particularly, a heat insulating packing may be interposed between the porous member 11 and the tap plate 50.

Figure 9:
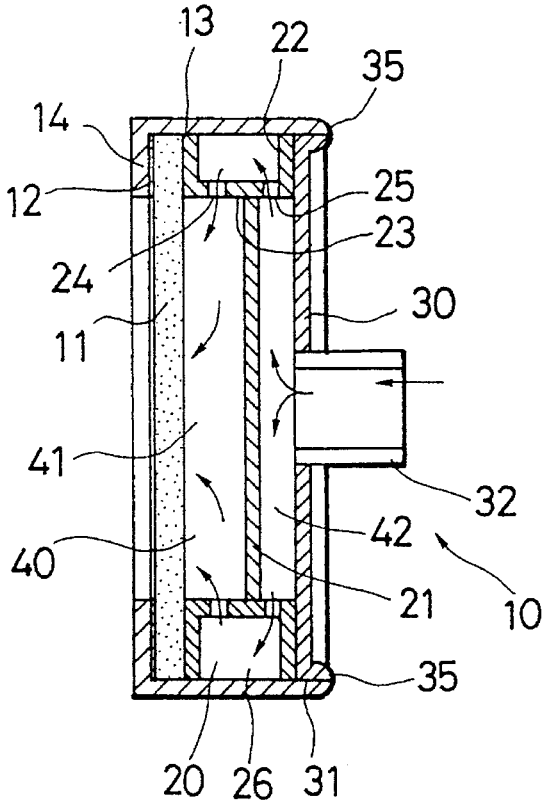
FIG. 9 is a sectional view of a prior art surface combustion burner.
Figure 10:
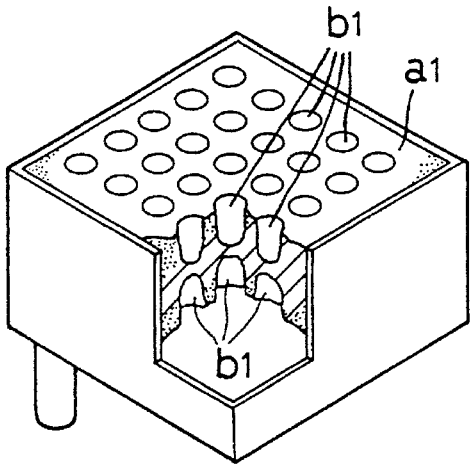
FIG. 10 is a perspective view, partly exploded, of another conventional surface combustion burner.
Figure 11:
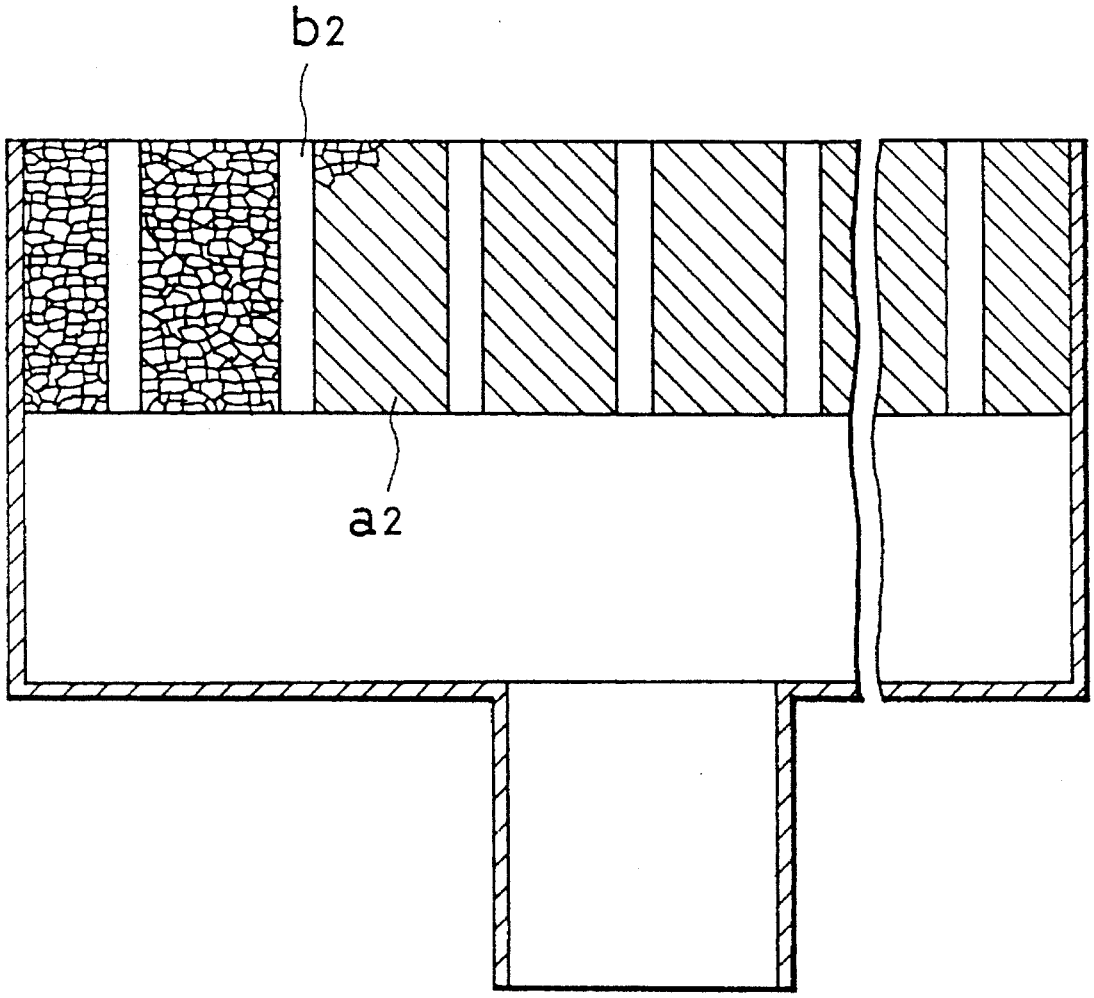
FIG. 11 is a sectional view of still another conventional surface combustion burner.

The surface combustion burner constructed as above differs from the conventional burners shown in FIGS. 9, 10 and 11 in that the mixing chamber is divided into a first mixing chamber defined by the bottom 3 of casing 2, the inner surface of partition wall 8 and the porous member 11, and a second mixing chamber surrounding the outer periphery of the first mixing chamber and defined by the bottom 3 of casing 2, the outer surface of partition wall 8, the inner surface of the cylindrical peripheral wall of casing 11 and the porous member 2, the first and second mixing chambers being independent of each other. Accordingly, a fuel gas mixture coming from the cylindrical tube 4 passes through the first mixing chamber and a central portion of the porous member 11 so as to be burnt at the surface thereof, whereas a fuel gas mixture coming from the tube 5 passes through the second mixing chamber and a peripheral portion of the porous member 11 so as to be burnt at the surface thereof, thus substantially preventing the fuel gas mixtures from mixing together.

Figure 2:
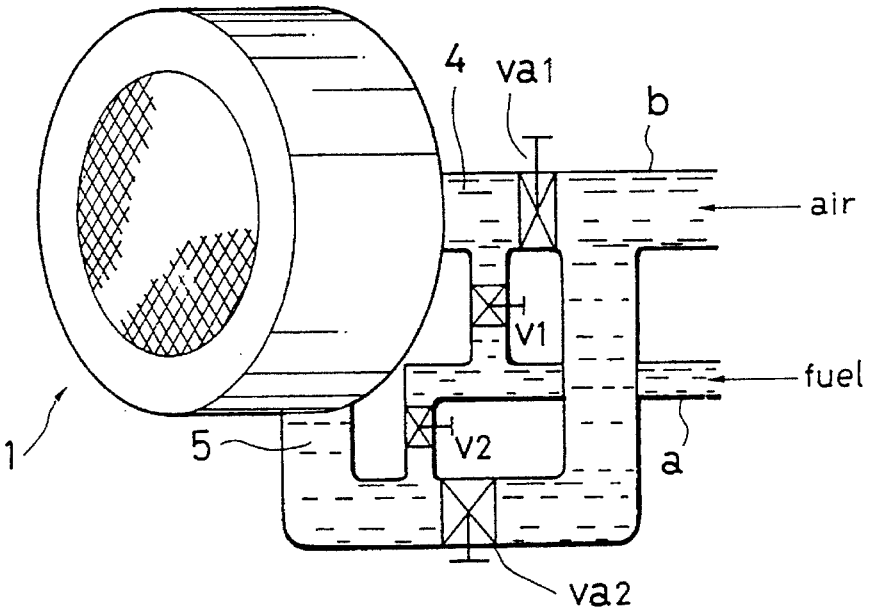
FIG. 2 is a diagram useful to explain an embodiment of piping means for supplying a fuel gas mixture.

FIG. 2 shows an embodiment of a piping system for use with the surface combustion burner according to the invention. A gas pipe arrangement a is connected to a suitable fuel supply source, not shown, and merges into two branches of which one is connected to the first tube 4, directly in communication with the first mixing chamber, through a flow control valve v1 and the other is similarly connected to the second cylindrical tube 5, in communication with the second mixing chamber, through a flow control valve v2. An air pipe arrangement b is connected to an air supply source, not shown, and also merges into two branches of which one is connected to the first tube 4, in communication with the first mixing chamber, through a flow control valve va1 and the other is similarly connected to the second tube 5, in communication with the second mixing chamber through a flow control valve va2.

When using the surface combustion burner 1 of this embodiment together with the piping of the above construction, fuel gas and air, respectively, supplied from the suitable sources to the gas pipe arrangement a and air pipe arrangement b in accordance with the burner use ambiance are suitably regulated by means of the flow control valves v1, v2, va1 and va2, so that fuel gas mixtures, at different air ratios, are supplied to the first and second mixing chambers simultaneously.

As has already been described hereinbefore, by setting a value of air ratio of the fuel gas mixture supplied to the first mixing chamber to a higher value than that of the fuel gas mixture supplied to the second mixing chamber, preferably, by setting the former air ratio to about 1.3 and the latter air ratio to 1.1 and performing combustion, high load, lean premixed, combustion can be carried out for a long time under the condition that generation of NOx is less as compared to that in the conventional burner.

Figure 3:
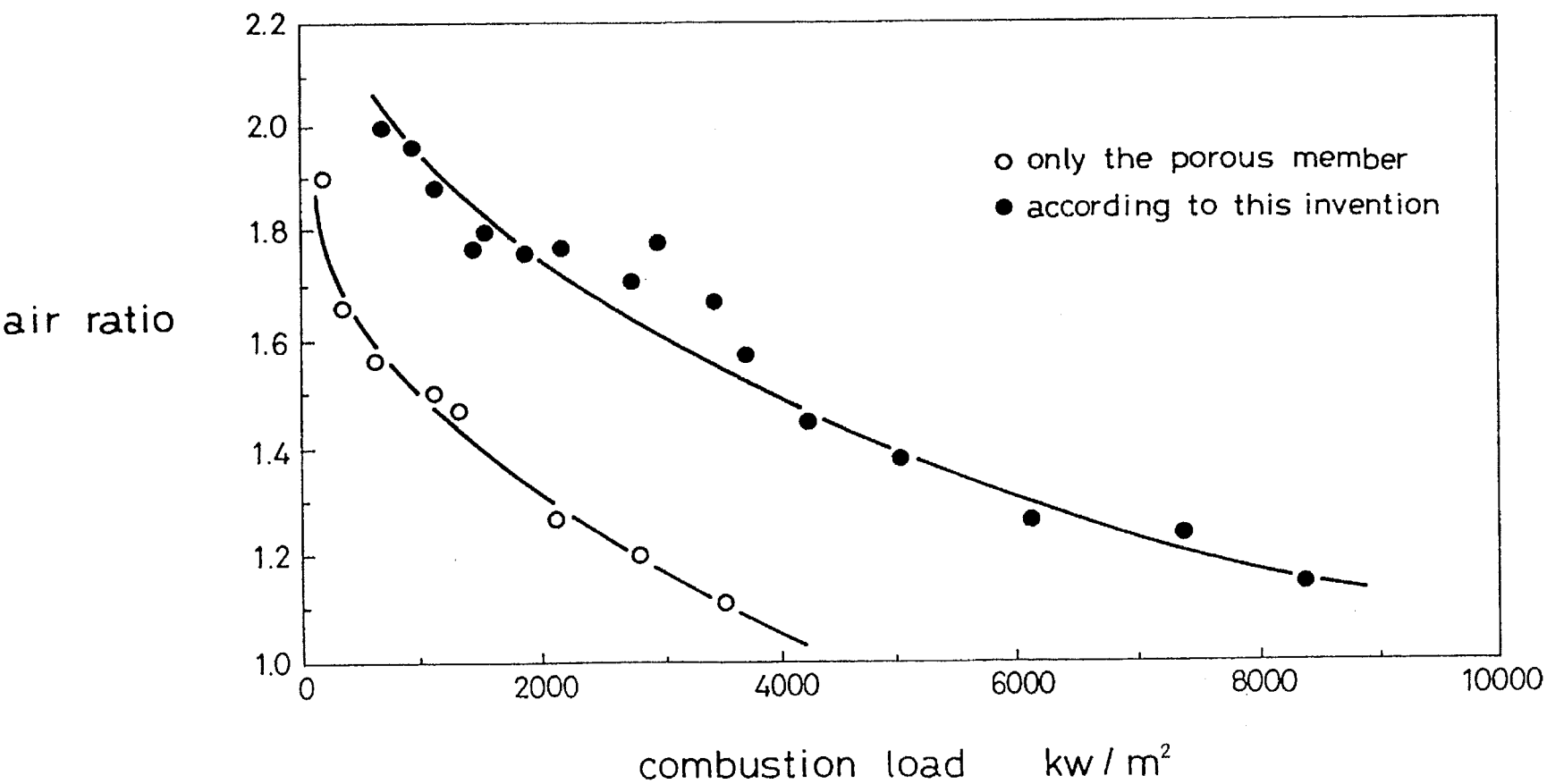
FIG. 3 is a graph showing results of comparison of lift limit curves obtained with the conventional surface combustion burner and the FIG. 1 surface combustion burner.

In effect, when combustion experiments were conducted using the same fuel gas mixture in the surface combustion burner of the conventional type shown in FIG. 9 and the surface combustion burner according to the present invention, lift limit curves, as graphically shown in FIG. 3, were obtained with the both burners (values of air ratio were measured at a central portion of the porous member of the burner used). FIG. 3 demonstrates that, at the same air ratio, the surface combustion burner of the present invention can maintain a stable combustion state in higher combustion load conditions. In the porous member mounted to the burners used in the experiments, voids are distributed substantially uniformly, having a percentage of voids of 96% and a surface area of 132 $cm^2$. The experimental results for the case of "only the porous member" are obtained by supplying a fuel gas mixture at an air ratio of 1.3 to 2.0 to the entire surface of the porous member and the experimental results for the case of "according to this invention" are obtained by supplying a fuel gas mixture at the same air ratio as that of the case of "only the porous member" to a central portion of about 95 $cm^2$ and supplying a fuel gas mixture at a lower air ratio of 1.1 to a peripheral edge portion of about 37 $cm^2$.

A second embodiment of the invention will now be described wherein, in a surface combustion burner comprising a porous member having its front surface constituting a combustion surface, the porous member has a resistance against the flow velocity of fuel gas mixture which is made to be higher at a peripheral edge nearby region of the porous member than at the remaining region.

In this embodiment, the conventionally known burner, for example, described with reference to FIGS. 9, 10 and 11, can be used without alternation or the surface combustion burner 1 according to the first embodiment described previously can also be used, provided that the porous member is shaped differently. Accordingly, the following description will be given of only the porous member and any description of the burner per se will be omitted.

Figure 4A:
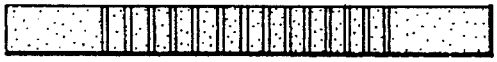
FIG. 4(*a*) and FIG. 4(*c*) illustrates, in sectional form, at FIGS. 4(*a*) to (*c*) examples of a porous member according to a second embodiment of the invention.
Figure 4B:
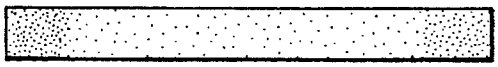
Figure 4C:
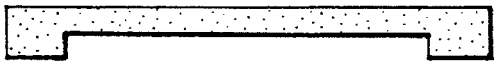

In the present embodiment, the resistance against the flow velocity of fuel gas mixture can be made to be different for the peripheral edge nearby region of the porous member and the remaining region as exemplified at (*a*) in FIG. 4 wherein a great number of through holes are formed in a region of the porous member excepting its peripheral edge nearby region, as exemplified at (b) in FIG. 4, wherein a material forming the porous member has a percentage of voids which is large at the peripheral edge nearby region and small at the remaining region or, as exemplified at (*c*) in FIG. 4, wherein the thickness of the porous member is made to be larger at the peripheral edge nearby region than at the remaining region.

The term "the peripheral edge nearby region" of the porous member has no critical meaning and its optimum area can be determined numerically through experiments by taking into account the size of the burner, the size of the porous member, the kind of a fuel gas mixture used and the use ambiance of the burner. Further, the porous member and "the peripheral edge nearby region" can be shaped desirably. The size and number of the through holes to be provided, the difference in percentage of voids and the difference in thickness can also be determined experimentally.

Figure 5:
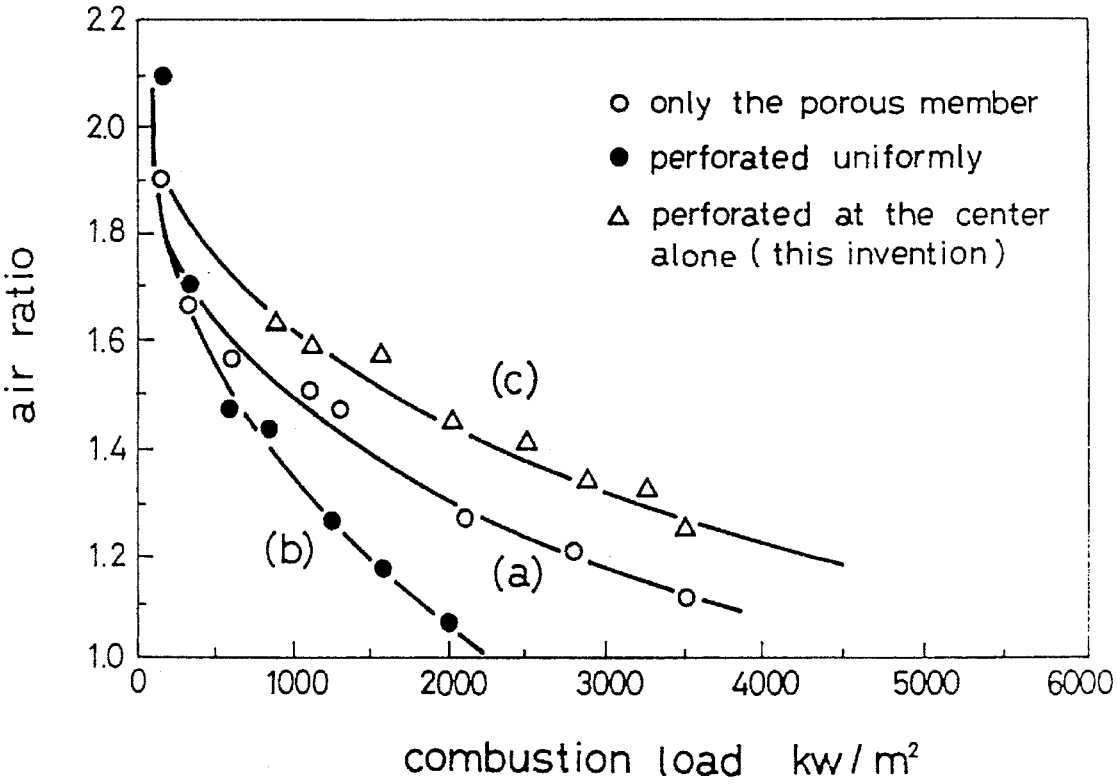
FIG. 5 is a graph showing results of comparison of lift limit curves obtained with various types of porous members including the FIG. 4(*a*) and FIG. 4(*c*) porous member.

Results of combustion tests conducted practically with the porous member according to the second embodiment of the invention and the porous member in the prior art are graphically shown in FIG. 5. In the experiments, surface combustion burners of the type as shown in FIG. 9 having each in particular a circular combustion surface were used with the same fuel gas mixture to measure limit combustion loads at which lift takes place at different air ratios, for three cases (a) where a porous member having a combustion surface in its original form is used, (b) where through holes are formed or perforated at uniform percentage over the entire porous member and (c) where through holes are formed or perforated at uniform percentage in a region of a porous member excepting its peripheral edge nearby region (corresponding to the porous member of the second embodiment).

The porous member used was made of iron, chromium, silicon, aluminum or yttrium, having in its original form an effective surface area of 169 $cm^2$ and a percentage of voids, distributed substantially uniformly, of 81% and it was used as it was for the aforementioned case (a), was altered or modified for the case (b) such that a great number of through holes having each a diameter of 1.0 mm are formed to provide a percentage of voids of 96% over the entire region and was modified for the case (c) such that a peripheral edge nearby region and a central region are defined concentrically to have an area ratio of the former region to the latter region which is 1.15:1 and a plurality of through holes having each a diameter of 1.1 mm are formed in the central region to provide a percentage of voids of 96%. The air ratio was measured at the central portion of the porous member of the burner used.

It will be appreciated, from FIG. 5, that for the same air ratio, the surface combustion burner using the porous member according to the invention can maintain a stable combustion state even in higher combustion load conditions as compared to the conventional surface combustion burner.

As described previously, in the surface combustion burner using the porous member according to the second embodiment of the invention, the resistance against the flow velocity at the peripheral edge nearby region of the porous member forming the combustion surface is different from that at the remaining region (an inward main combustion portion). Accordingly, in the burner using the porous member of this embodiment, a fuel gas mixture is resisted more largely at the peripheral edge region on the combustion surface than at the central portion even when the fuel gas mixture is supplied to the mixing chamber uniformly under the same condition, and quantity of fuel gas mixture supply peripheral edge and central portions. Consequently, when the burner is used at a low combustion load, main combustion is carried out giving off stable flames at the central region where the resistance is low. As the quantity of supply of the fuel gas mixture increases, a large amount of the fuel gas mixture is supplied to the central portion to produce pale blue flame combustion and high intensity combustion is conducted, whereas a small amount of fuel gas mixture is supplied to the peripheral edge nearby region to maintain a stable combustion state freed from flame lift at the peripheral edge portion. Through this, the flames at the central portion performing the high intensity combustion can be protected by the stable flames to prevent the occurrence of lift, as in the case of the surface combustion burner according to the first embodiment.

In this manner, surface high load combustion at higher load can afford to be conducted with the surface combustion burner of the present embodiment and advantageously, even with the burner of the same size as that of the conventional burner, the combustion load range can be increased, low NOx combustion can be permitted and size-reduction of the combustion chamber can be achieved.

A third embodiment of the invention will now be described wherein in a surface combustion burner comprising a porous member having its front surface constituting a combustion surface, a great number of through holes having diameters each larger than that of a small porosity of the porous member are formed in the porous member substantially vertically to the surface thereof and the great number of through holes are sorted into several kinds of groups of through holes having different diameters.

In this embodiment, too, the surface combustion burner 1 according to the previously-described first embodiment of the invention or for example, the conventionally known burners described with reference to FIGS. 9, 10 and 11 can be used without alternation as the burner proper, provided that the porous member is shaped differently as will be described with reference to FIGS. 6 and 7. Accordingly, in the following, only the porous member will be described principally and the burner, per se, will not be described.

Figure 6:
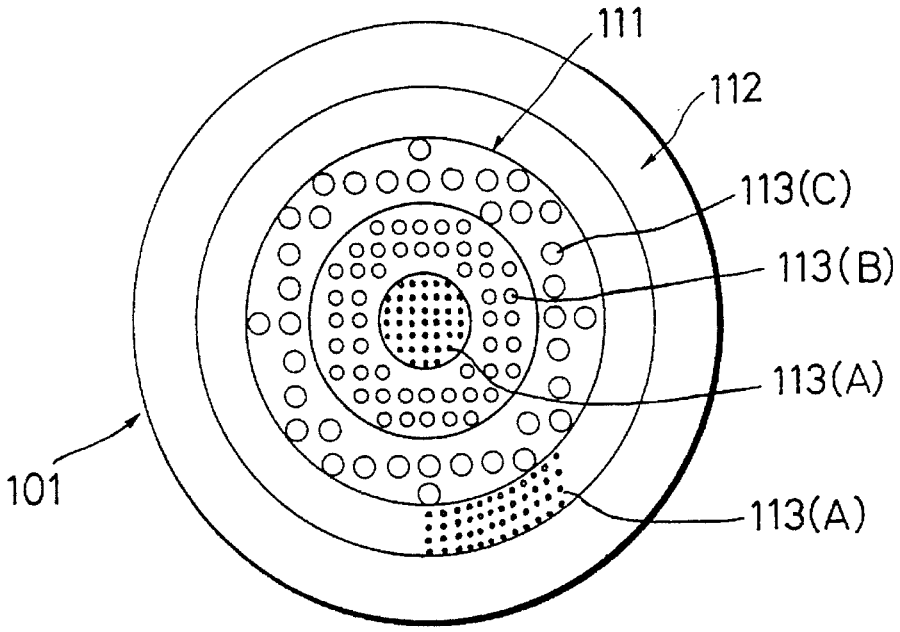
FIGS. 6 and 7 are sectional diagrams of examples of a porous member according to a third embodiment of the invention.
Figure 7:
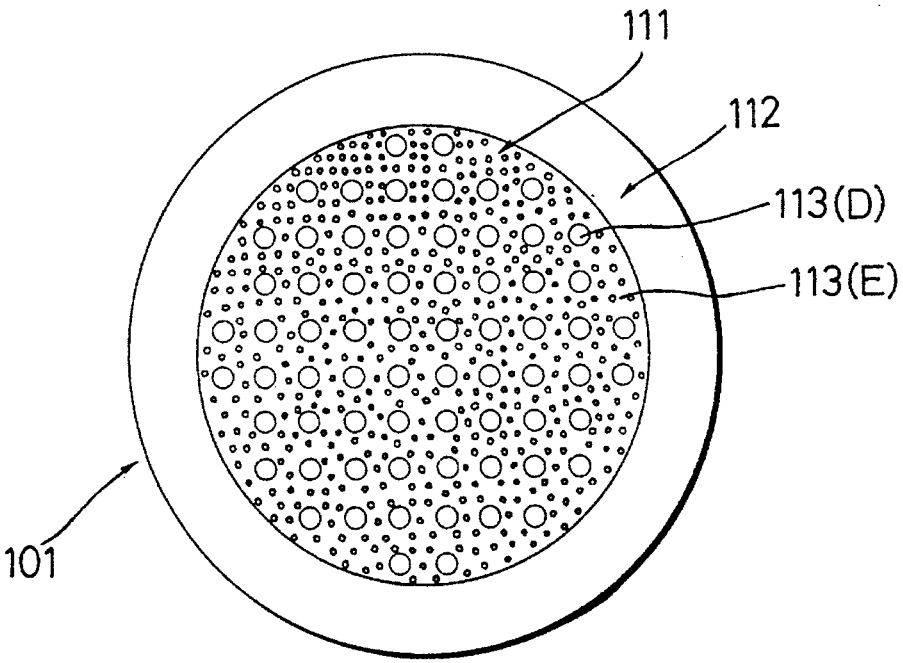

FIGS. 6 and 7 are plan views showing examples of porous member. A porous member 101 illustrated therein is formed of thin metal fibers which are conglomerated in the form of an unwoven sheet having a great number of small porosities of about 100 μm diameter. This planar porous member 101 covers both of a central high load lean premixed combustion region 111 corresponding to the first mixing chamber of the surface combustion burner shown in FIG. 1 and a peripheral stable combustion region 112 corresponding to the peripheral second mixing chamber. In the central high load lean premixed combustion region 111, a great number of through holes 113, having diameters larger than that of the small porosities of the porous member, are formed substantially vertically to the surface thereof, and the great number of through holes 113 are sorted into several kinds of groups of through holes having different diameters. In essentiality, the several kinds of groups of through holes having different diameters may be arranged randomly but, preferably, the arrangement may be patterned according to a predetermined rule.

Firstly, in a first example shown in FIG. 6, groups of three kinds of different-diameter through holes 113A (D1.0–P2.5), 113B (D3.0–P5.0) and 113C (D5.0–P7.5) are arranged, in the circular central portion 111 standing for the high load lean premixed combustion region of the porous member 101, from the center of the porous member to the outer periphery in the order of A-B-C-A, so that the through holes 113 are formed in a pattern in which the diameter is changed stepwise (where D represents the diameter of a through hole (mm) and P represents the mean distance between adjacent through holes (mm)).

In a second example, shown in FIG. 7, groups of two kinds of different-diameter through holes 113D (D1–P5) and 113E (D5–P10) are arranged also in the circular central portion 111 standing for the high load lean premixed combustion region of the porous member 101 in a pattern in which through holes 113D of small diameter surround through holes 113E of large diameter.

Figure 8:
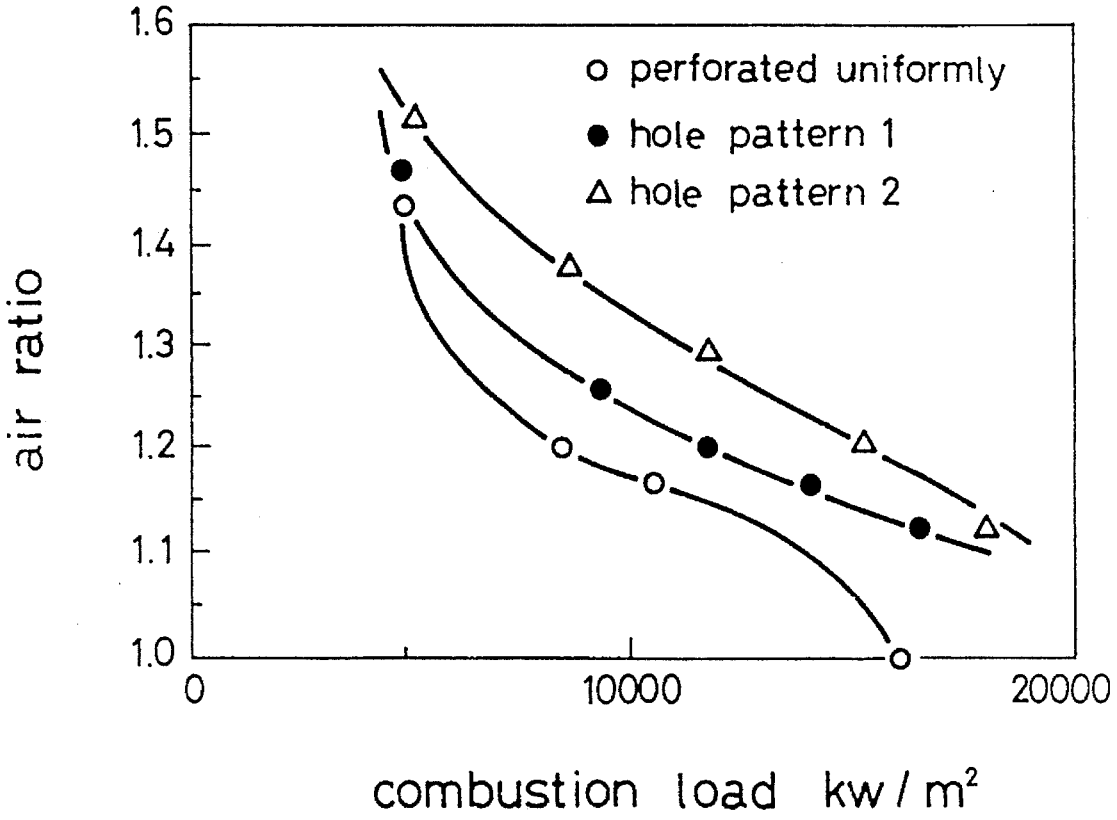
FIG. 8 is a graph showing results of comparison of lift limit curves obtained with various types of surface combustion burners including burners using the porous members shown in FIGS. 6 and 7.

Experimentally, the stable combustion limit of surface combustion burners, respectively having porous members 101 formed with patterns of through holes as described previously was compared with that of a surface combustion burner having a planar porous member which, as in the foregoing embodiments, has a peripheral stable combustion region and a high load lean premixed combustion region positioned inwardly of the stable combustion region and has through holes (D1.0–P2.5) of uniform size formed in the high load lean premixed combustion region. Results are shown in FIG. 8 (where the pattern shown in FIG. 6 is denoted by hole pattern 1 and the pattern shown in FIG. 7 is denoted by hole pattern 2). It should be understood that the surface combustion burners according to the invention are clearly improved in the stable combustion limit as compared to the conventional surface combustion burner.

The present invention has been described by way of preferred embodiments thereof but it is not limited thereto and may be modified in various ways. For example, in the first embodiment, the whole shape of the casing is not limited to the cylindrical shape of circular cross section but may have a cylindrical shape of square or elliptic cross section, and besides the partition wall defining the first and second mixing chambers, may have a desired shade. Further, the volume ratio between the first and second mixing chambers, or the ratio between surface areas of the porous member which contact the first and second mixing chambers, are not limited to those described previously but may be set experimentally to optimum values in accordance with the use ambiance of the burner.

Furthermore, the construction of the surface combustion burner, excepting the structure of the porous member 101, used in the third embodiment is not limited to that shown in FIGS. 1 and 2 but the third embodiment may be applied to a different type of construction, for example, having no partition wall 8 for partitioning the mixing chamber, and besides the pattern of through holes is not limited to those shown in FIGS. 6 and 7 but may be realized with various forms, provided that two or more kinds of groups of through holes having different diameters which are larger than the diameter of a small porosities of the porous member are distributed substantially uniformly over the combustion surface.

The surface combustion burner of the present invention has the construction set forth hereinbefore and especially, in the first embodiment, fuel gas mixtures can be supplied at different air ratios to the central and peripheral portions of the porous member serving as the combustion surface and by selecting the air ratios suitably, high load lean premixed combustion can be performed for a long time under the condition that NOx is less generated than in the conventional burner.

When the porous member, according to the second embodiment, is used, high intensity combustion can be effected at the main combustion surface in the central region while maintaining stable flames at the peripheral edge nearby region of the porous member serving as the combustion surface, by using the same casing per se as the conventional one and merely changing only the shape of the porous member, thereby permitting running over wide combustion load, and at the same time high load lean premixed combustion can be performed for a long time under the condition that NOx is less generated than in the the conventional burner.

Further, in the third embodiment, the flow velocity of fuel gas mixture can be changed partly at the high load lean premixed combustion region on the combustion surface by employing the simple construction in which several kinds of groups of through holes of different diameters are formed in the porous member in accordance with a predetermined pattern, whereby even when the combustion load changes, some portions of the combustion surface can behave as a stable combustion region which stabilizes surrounding unstable combustion portions. This permits the high load lean premixed combustion to be performed stably over a wide combustion load range and consequently ensures suppression of generation of NOx.

What is claimed is:

1. A surface combustion burner comprising a porous member having its front surface constituting a combustion surface, a casing extending rearward from an outer peripheral rear surface of said porous member, a mixing chamber defined by said porous member and said casing, opening means for suppling fuel air mixture to said mixing chamber, a partition wall dividing said mixing chamber into a first mixing chamber positioned at a central portion of a rear surface of said porous member and said mixing chamber and a second mixing chamber surrounding said first mixing chamber, and openings for supplying fuel air mixture to said first and second mixing chambers, respectively, said porous member having a percentage of voids which is higher at a portion confronting said first mixing chamber than at a portion confronting said second mixing chamber.

2. A surface combustion burner, as recited in claim 1, wherein said porous member has a resistance against the flow velocity of fuel gas mixture which is higher confronting said second mixing chamber than confronting said first mixing chamber.

3. A surface combustion burner, as recited in claim 1 wherein said porous member confronting said second mixing chamber is formed of a material having a percentage of voids which is smaller than confronting said first mixing chamber.

4. A surface combustion burner, as recited in claim 1 wherein said porous member has a thickness which is larger at said portion confronting said second mixing chamber than at said portion confronting said first mixing chamber.

5. A surface combustion burner comprising a porous member having its front surface constituting a combustion surface, a casing extending rearward from an outer peripheral rear surface of said porous member, a mixing chamber defined by said porous member and said casing, opening means for supplying fuel air mixture to said mixing chamber, a partition wall dividing said mixing chamber into a first mixing chamber positioned at a central portion of a rear surface of said porous member and said mixing chamber and a second mixing chamber surrounding said first mixing chamber, and openings for supplying fuel air mixture to said first and second mixing chambers, respectively, said porous member being formed with a great number of through holes at its portion confronting said first mixing chamber.

* * * * *